US006503048B1

(12) United States Patent
Mirsky

(10) Patent No.: US 6,503,048 B1
(45) Date of Patent: Jan. 7, 2003

(54) METHOD AND APPARATUS FOR ESTIMATING FLOW IN COMPRESSORS WITH SIDESTREAMS

(75) Inventor: Saul Mirsky, West Des Moines, IA (US)

(73) Assignee: Compressor Controls Corporation, Des Moines, IA (US)

( * ) Notice: Subject to any disclaimer, the term of this patent is extended or adjusted under 35 U.S.C. 154(b) by 0 days.

(21) Appl. No.: 09/942,368

(22) Filed: Aug. 27, 2001

(51) Int. Cl.[7] ..... F01D 21/12; F01D 21/14

(52) U.S. Cl. ..... 415/1; 415/17; 415/28; 415/47

(58) Field of Search ..... 415/1, 17, 27, 415/28, 47

(56) References Cited

U.S. PATENT DOCUMENTS

| | | | | | |
|---|---|---|---|---|---|
| 2,955,745 | A | * | 10/1960 | Hunter | 415/40 |
| 4,594,050 | A | * | 6/1986 | Gaston | 415/1 |
| 5,195,875 | A | * | 3/1993 | Gaston | 415/27 |
| 5,599,161 | A | * | 2/1997 | Batson | 415/1 |
| 5,743,715 | A | * | 4/1998 | Staroselsky et al. | 415/1 |
| 5,798,941 | A | * | 8/1998 | McLeister | 415/1 |
| 5,908,462 | A | * | 6/1999 | Batson | 415/1 |
| 5,915,917 | A | * | 6/1999 | Eveker et al. | 415/1 |
| 6,213,724 | B1 | * | 4/2001 | Haugen et al. | 417/18 |

OTHER PUBLICATIONS

Copy—5 pages from Fluid Mechanics—Thermodynamics of Turbomachinery 3rd Edition (in SI/Metric Units) by S.L. Dixon, B.Eng., Ph.D., C.Eng., MI.Mech.E.—University of Liverpool, England.

Copy—16 pages from Fundamentals of Engineering Thermodynamic—by Michael L. Moran and Howard N. Shapiro.

Copy—5 pages—from Series 3 Plus Antisurge Controller for Axial and Centrifugal Compressors—Publication IM301 (6.0.0)—Product Revision: 756–001—Feb., 1999 by Compressor Controls Corp.

* cited by examiner

*Primary Examiner*—John E. Ryznic
(74) *Attorney, Agent, or Firm*—Henderson & Sturm LLP

(57) ABSTRACT

Accurate and effective antisurge control for turbocompressor stages is augmented by measuring the flow rate of fluid entering or leaving the stage of compression. On the other hand, turbocompressors with sidestreams, such as ethylene, propylene, and propane refrigeration compressors, pose unique antisurge control challenges; in particular, measurements for the flow rate entering (or leaving) the compressors' middle stages are not available in most cases. Furthermore, the methods used to cope with this lack of flow measurements are prone to introducing errors and producing false transients, as well as being cumbersome and difficult to implement. For these reasons, this disclosure relates to a method for protecting turbocompressors with sidestreams from the damaging effects of surge. But more specifically, it describes a technique for estimating the reduced flow rate entering a compression stage not having a flow measurement device in its suction or discharge—that is, the flow rate entering a middle (intermediate) compressor stage can be inferred from known flow rates. The reduced flow rate is used to determine a location of the compression stage's operating point relative to its surge limit. The proposed method employs (1) the first law of thermodynamics to estimate the temperature of a flow entering one of the compressor stages, and (2) a relationship between the pressures and temperatures in suction and discharge used in conjunction with the first law of thermodynamics.

34 Claims, 10 Drawing Sheets

METHOD AND APPARATUS FOR ESTIMATING FLOW IN COMPRESSORS WITH SIDESTREAMS

TECHNICAL FIELD

This invention relates generally to a method and apparatus for protecting turbocompressors with sidestreams from the damaging effects of surge. More specifically, the invention relates to a method for estimating the reduced flow rate entering a compression stage that does not have a flow measurement device in its suction or discharge. Reduced flow rate is used to accurately calculate a location of the compression stage's operating point relative to its surge limit.

BACKGROUND ART

To implement accurate and effective antisurge control for turbocompressor stages, a flow measurement is of great value; that is, measuring the flow rate entering or leaving the stage of compression. Turbocompressors with sidestreams, such as ethylene, propylene, and propane refrigeration compressors, pose unique antisurge control challenges. In particular, measurements for the flow rate of fluid entering (or leaving) the compressors' middle stages are not available in most cases. However, flow rates are often known for the first and/or last compressor stage(s) and the sidestreams.

Present-day control systems for multistage compressors with sidestreams use either of two methods to cope with the lack of flow measurement. In the first method, the control algorithm utilizes an assumption of constant ratios $$\frac{(ZT)_{2s}}{(ZT)_{1d}} = C_1,\ \frac{(ZT)_{2s}}{(ZT)_{SS}} = C_2,\ \frac{(ZT)_{2s}}{\sqrt{(ZT)_{1d}(ZT)_{SS}}} = C_3$$

and calculates an estimate of a differential pressure (for a phantom flow-measurement in the suction of the compressor stage not having a flow measurement) as a function of the differential pressures measured across the existing flow measurement devices. Of course, anytime the above constant ratios are not equal to the originally calculated constant, errors are introduced; furthermore, this method is very cumbersome and difficult to implement.

The second method is described in U.S. Pat. No. 5,599,161 by Batson entitled, "Method and Apparatus for Antisurge Control of Multistage Compressors with Sidestreams": instead of reduced flow rate, a different similarity variable is used in which the temperature of the flow into those stages not having flow measurements is unnecessary. When response times of the various measurement devices vary, it is possible that this method could produce false transients.

For the reasons mentioned, there is an obvious need for a simple and accurate antisurge-control algorithm for multistage turbocompressors with sidestreams.

DISCLOSURE OF THE INVENTION

The purpose of this invention is to improve upon the prior art by providing a method whereby the flow rate entering a middle (intermediate) compressor stage can be inferred from known flow rates. One of the keys to accomplishing this flow calculation is the first law of thermodynamics (or the conservation of energy equation):

$$\frac{\partial}{\partial t}\iiint_{CV} e\rho\, d\underline{V} + \iint_{CS}\left(h + \frac{1}{2}V^2 + gz\right)\rho\vec{V}\cdot d\vec{A} = \dot{Q} + \dot{W} \tag{1}$$

where t=time e=specific total energy of the fluid p=density $\underline{V}$=volume CV=control volume (open system)

CS=control surface (boundary of the control volume)

h=specific enthalpy

V=velocity g=acceleration of gravity z=elevation

A=area $\dot{Q}$=net rate of heat transfer into the control volume $\dot{W}$=net rate of shaft and shear work into the control volume Another key to effectuating this invention is a relationship between the pressure and temperature ratios across a compressor. The following is true if the compression process is assumed polytropic:

$$\frac{p_s}{\rho_s^n} = \frac{p_d}{\rho_d^n} \tag{2}$$

where p=absolute pressure s=suction d=discharge n=polytropic exponent

Now the equation of state is also invoked:

$$p=\rho ZRT \tag{3}$$

where

Z=compressibility

R=gas constant

T=temperature

Finally, it is easily shown that $$\frac{T_d}{T_s} = \frac{Z_s}{Z_d}\left(\frac{p_d}{p_s}\right)^{\frac{n-1}{n}} \tag{4}$$

which is the relationship between the temperature and pressure ratios across a compressor when the compression process is assumed polytropic.

BEST MODE FOR CARRYING OUT THE INVENTION

Figure 1:
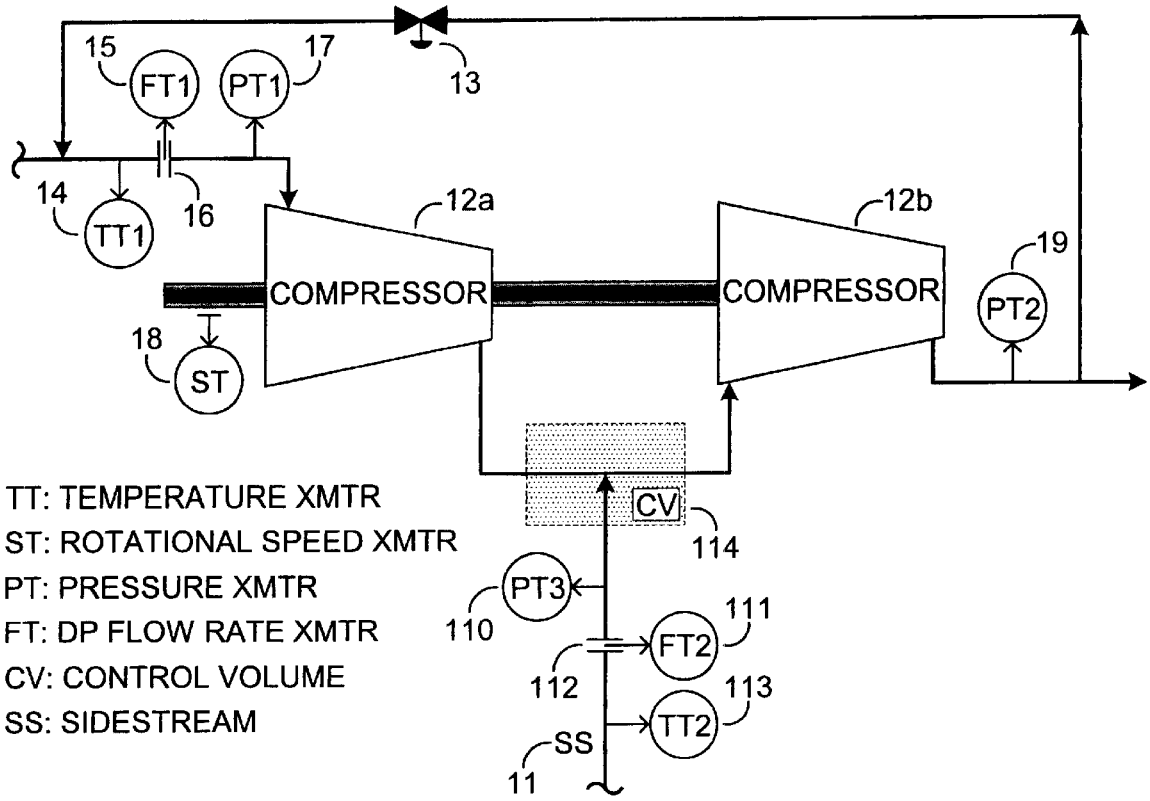
FIG. 1 shows two stages of compression with a sidestream.

FIG. 1 depicts a representative compressor system with associated piping and a sidestream (SS) 11. The system includes two compressors 12*a*, 12*b*; a bypass valve 13; and the following transmitters:

compressor suction-temperature (TT1) 14, differential pressure (FT1) 15 measuring the differential pressure across a flow measuring device 16, compressor suction-pressure (PT1) 17, rotational speed (ST) 18, compressor discharge-pressure (PT2) 19, sidestream pressure (PT3) 110, differential pressure (FT2) 111 measuring the differential pressure across a flow measuring device 112, and sidestream temperature (TT2) 113.

Figure 2:
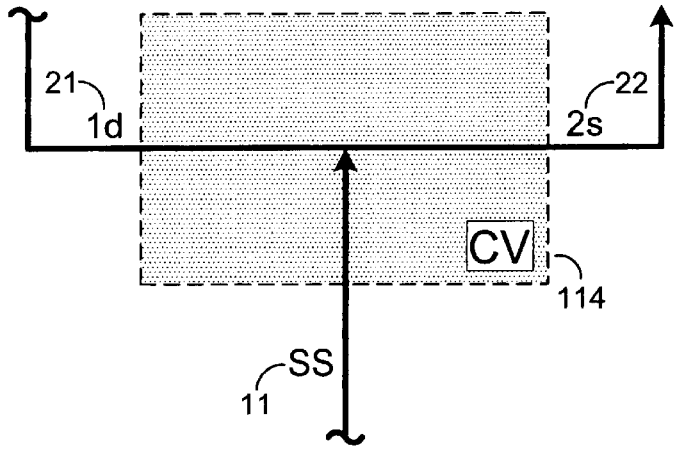
FIG. 2 shows a control volume used for a first-law analysis.
Figure 3:
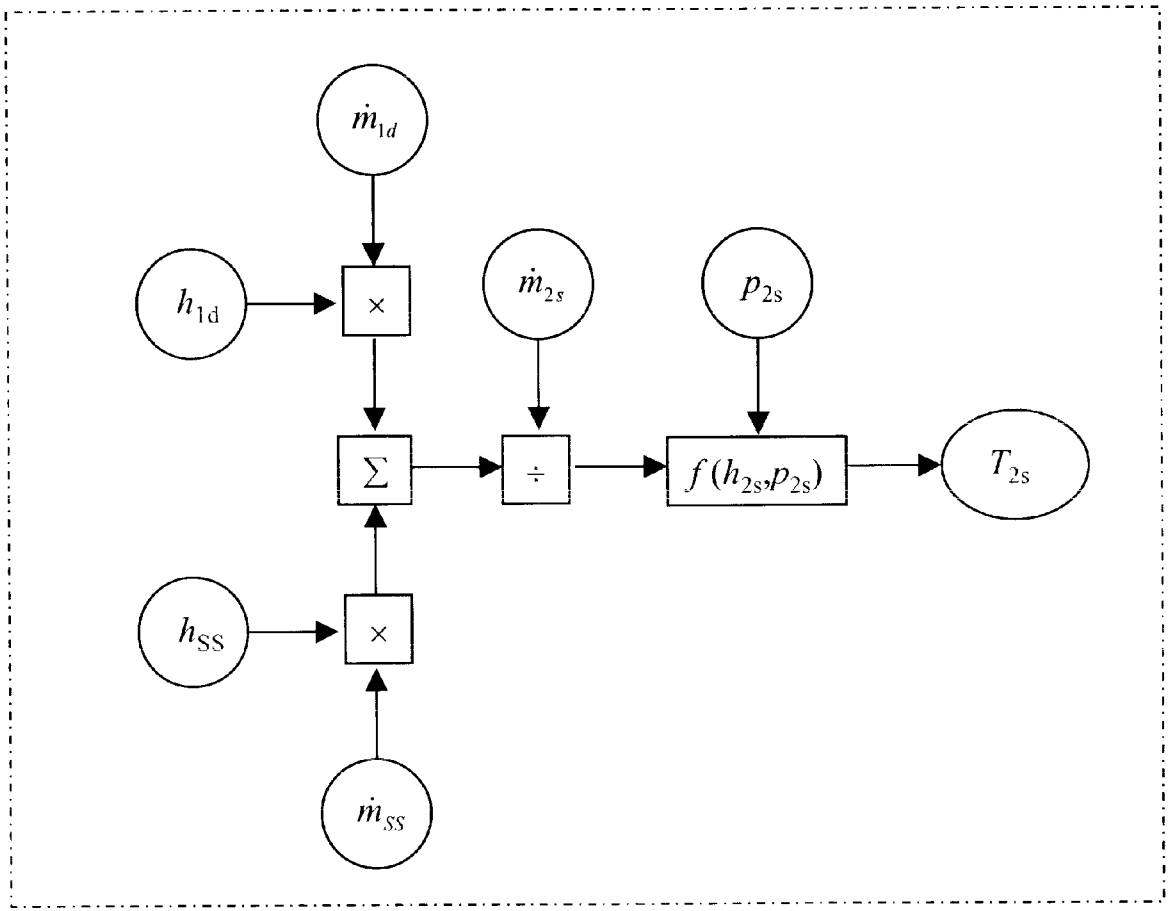
FIG. 3 represents a processor executing Eq. (10) for claims 18 and 34.
Figure 4:
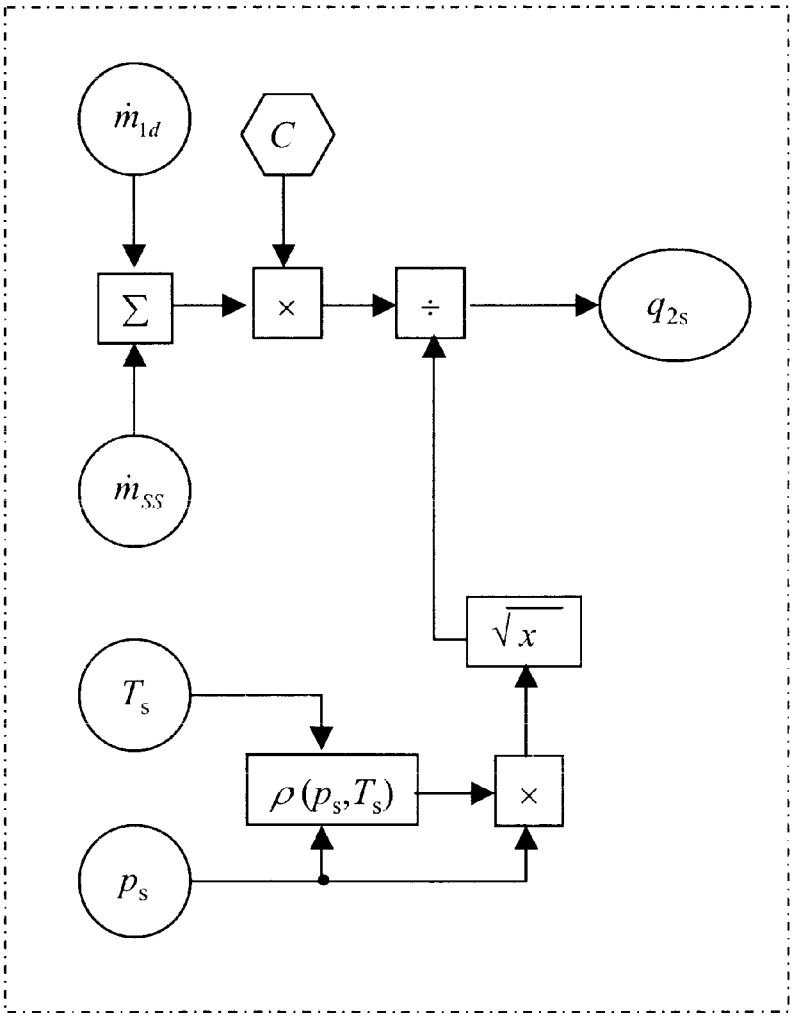
FIG. 4 represents a processor executing Eq. (11) for claims 19 and 20.
Figure 5:
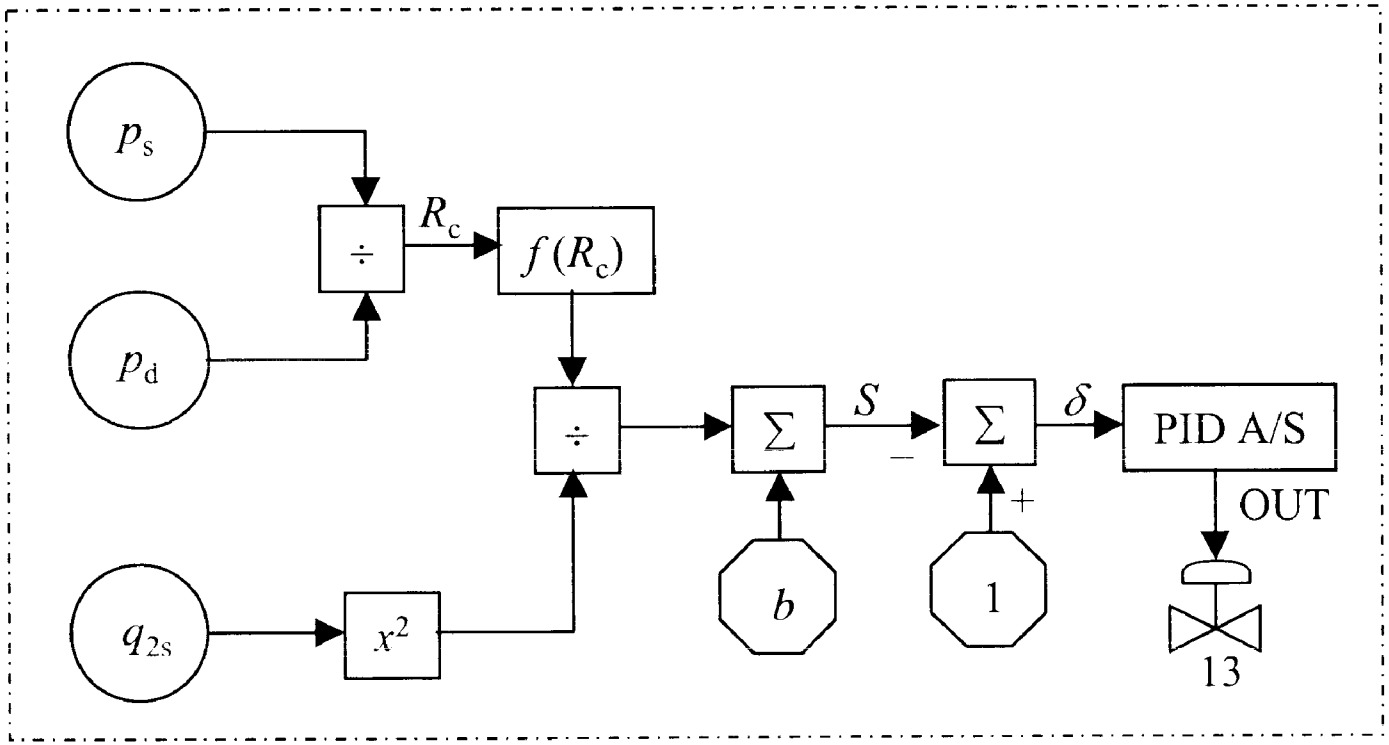
FIG. 5 represents a processor calculating a deviation for antisurge control as disclosed in claims 18 and 21.
Figure 6:
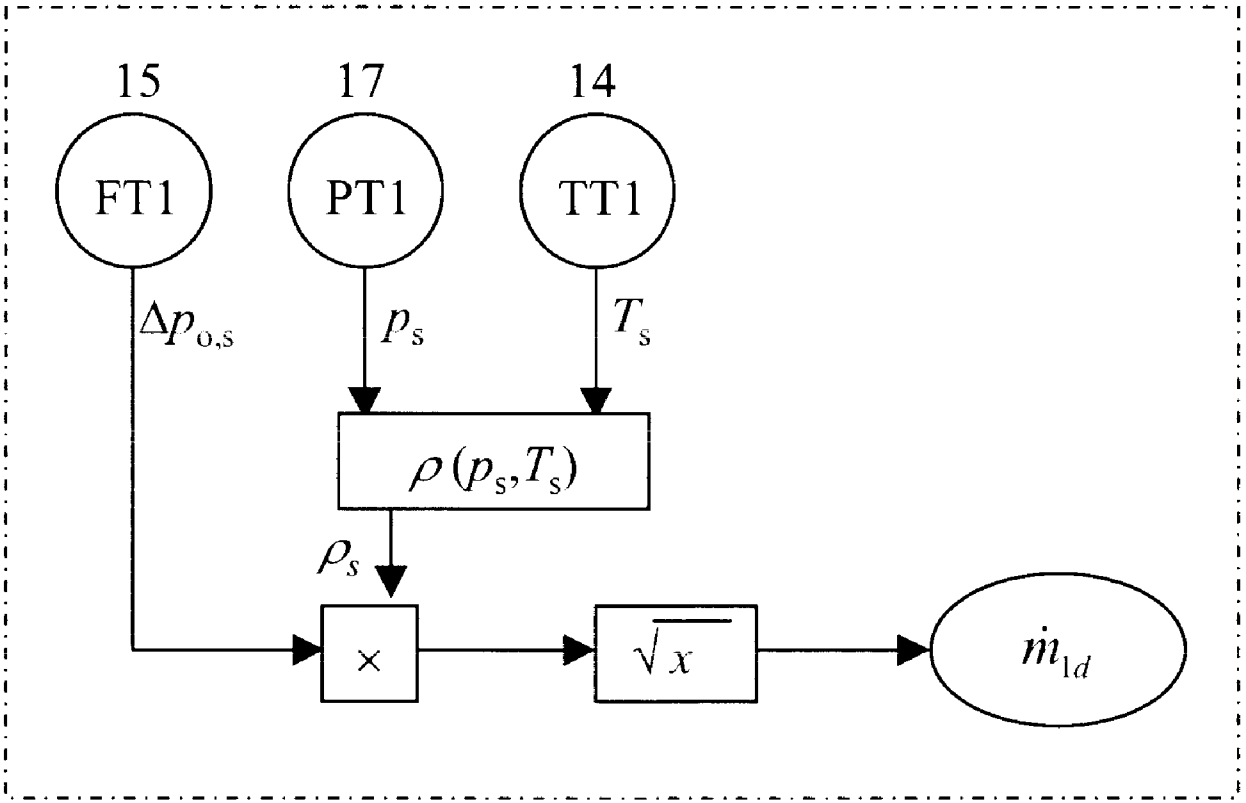
FIG. 6 represents a processor calculating a mass flow rate at a discharge of a first stage of compression as shown in Eq. (7) for claim 22.
Figure 7:
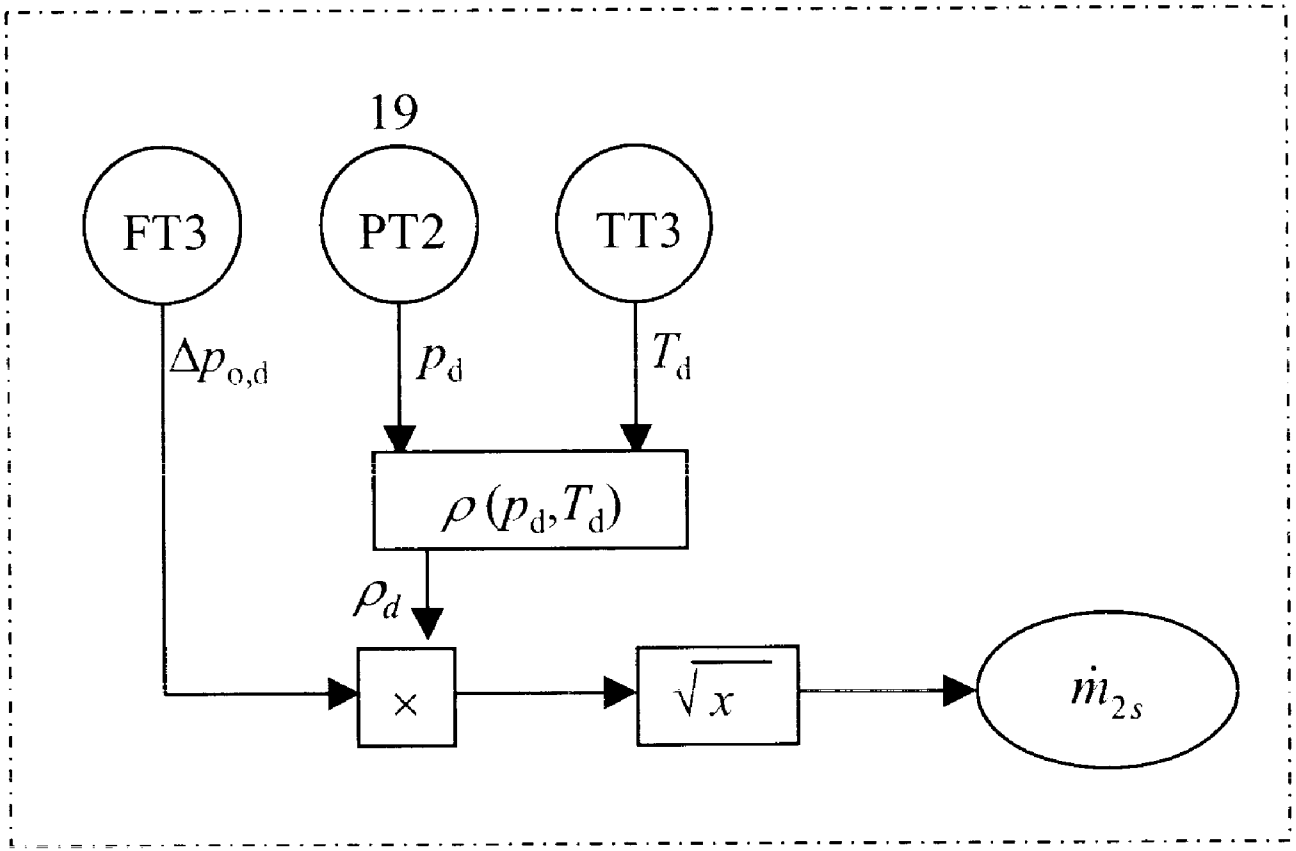
FIG. 7 represents a processor calculating a mass flow rate at a suction of a second stage of compression as shown in Eq. (7) for claim 23.
Figure 8:
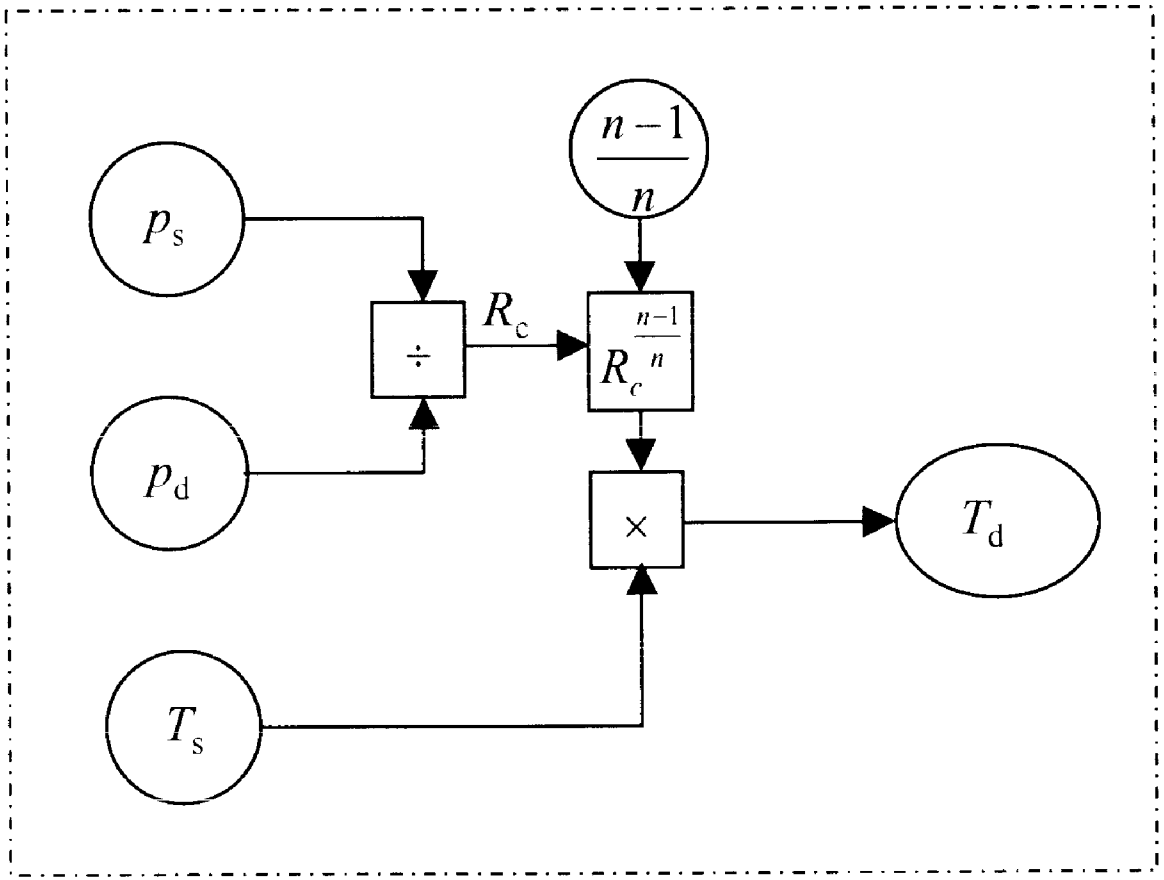
FIG. 8 represents a processor calculating a discharge temperature as a function of a pressure ratio as per Eq. (13) for claims 24–27.
Figure 9:
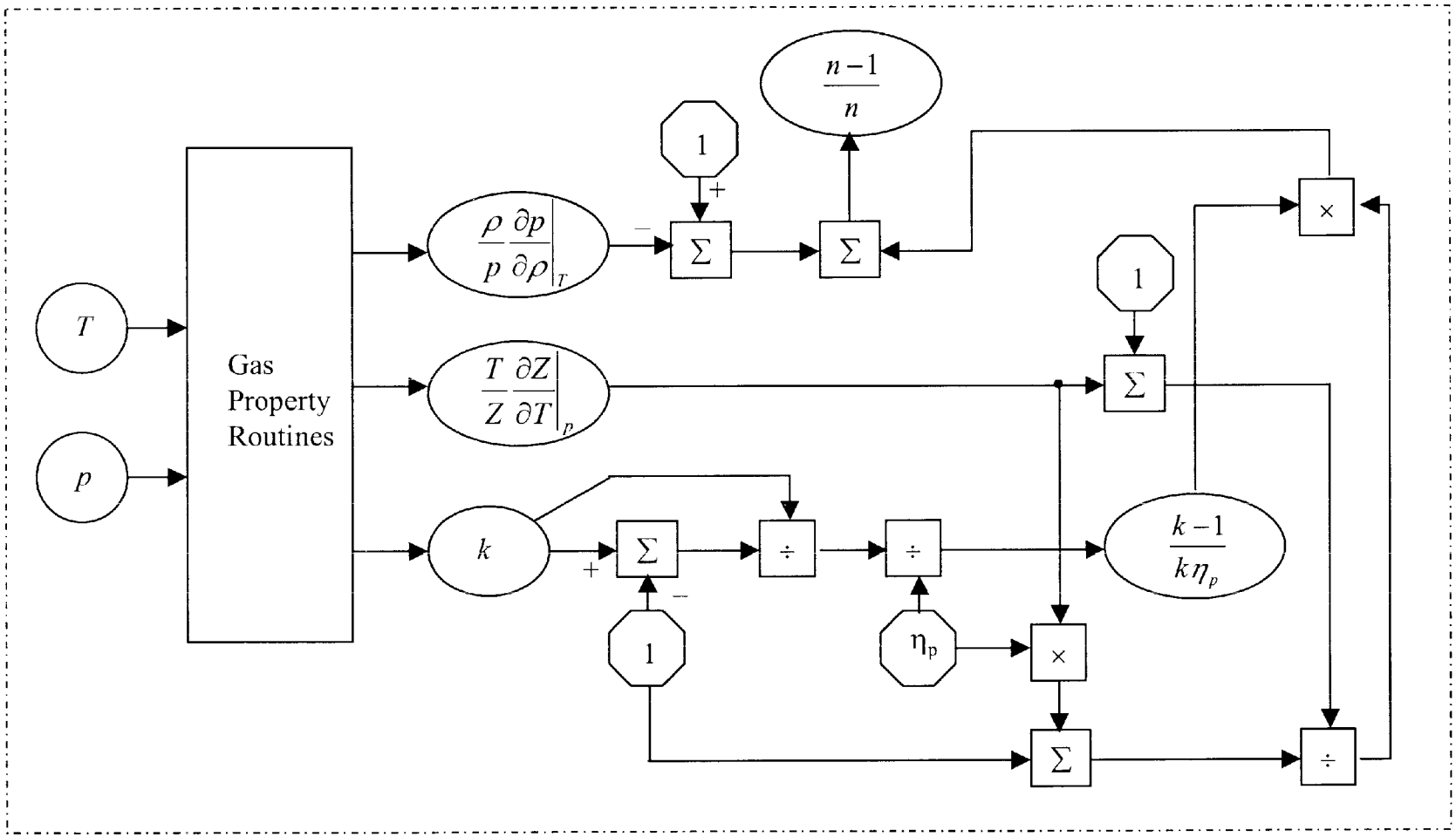
FIG. 9 represents a processor calculating the quantity (n−1)/n in Eq. 9 for claims 28 and 30.
Figure 10:
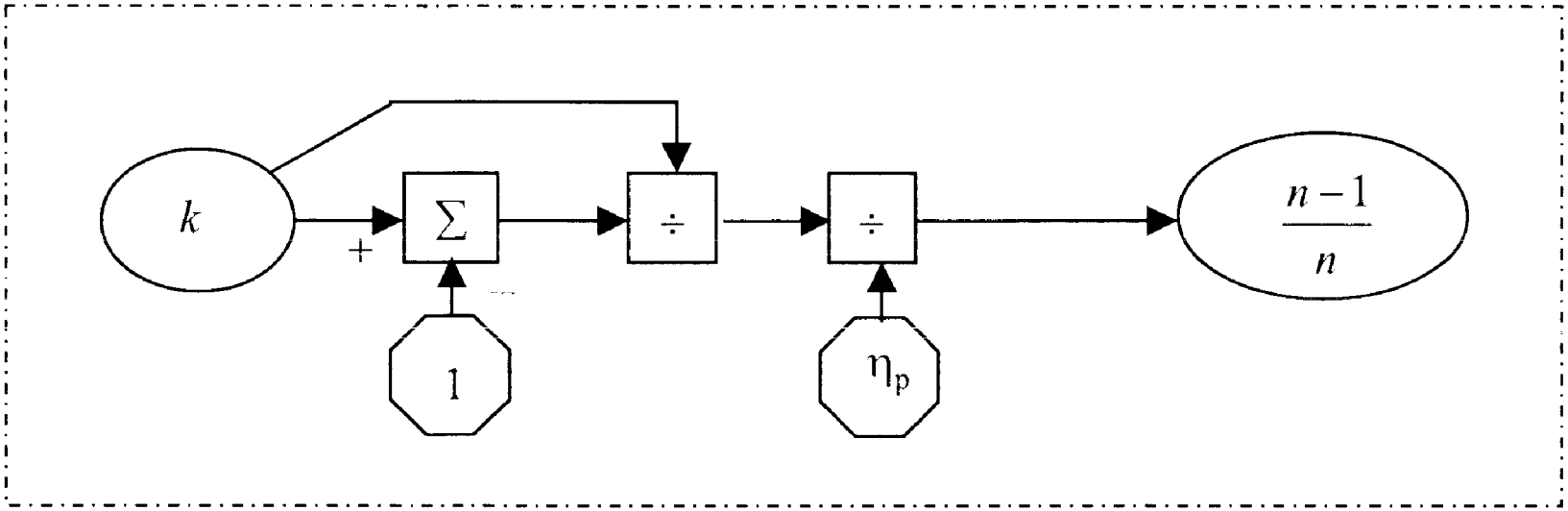
FIG. 10 represents a processor calculating the quantity (n−1)/n in Eq. 14 for claims 29 and 30.
Figure 11:
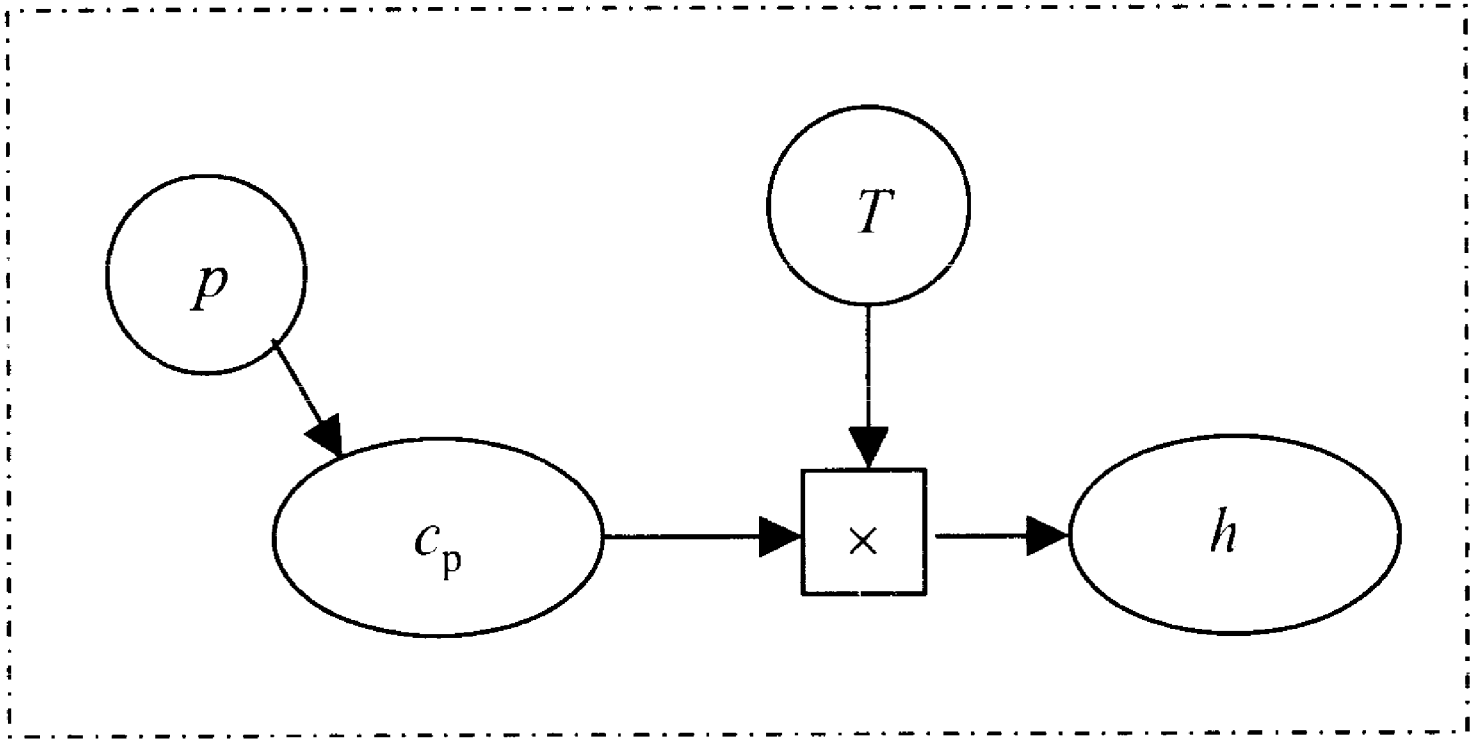
FIG. 11 represents a processor calculating an enthalpy using a specific heat for constant pressure for claims 31–33.

For the purposes of the present invention, the first law of thermodynamics is applied to a control volume (CV) 114, shown as a shaded box in FIG. 1 and expanded in FIG. 2. Several assumptions are required before arriving at a form of Eq. (1) simple enough to be practical for application to this case. First, steady flow is assumed; therefore, the first term in Eq. (1), the partial derivative term, goes to zero. Second, heat transfer and work are expected to be negligible in this control volume. Third, the properties across each of the inlet and outlet ports are assumed uniform; as a result, the double integral can be simplified to a summation. Last, the potential and kinetic energy terms are ignored. With these four assumptions, Eq. (1) becomes $$\sum_i (\dot{m}h)_i = 0 \tag{5}$$

where the summation is taken over all the inlet and outlet ports (i), or $$(\dot{m}h)_{1d}+(\dot{m}h)_{SS}-(\dot{m}h)_{2s}=0 \tag{6}$$

From the pressure 110, flow 111, and temperature 113 measured at the sidestream (SS) 11 shown in FIG. 1, the mass flow rate ($\dot{m}$) for the sidestream can be calculated:

$$\dot{m} = A\sqrt{\Delta p_o \rho} = A\sqrt{\Delta p_o \frac{p}{ZRT}} \tag{7}$$

where $\Delta p_o$ is the differential pressure across a flow measurement device 112, and A is a constant based upon the geometry of the flow measurement device.

Because two independent properties are required to fix the state of a simple compressible substance, specific enthalpy (h) of the sidestream flow can be calculated from the temperature and pressure, using well known gas-property relations. Mass flow rate ($\dot{m}$) through the upstream compressor stage 12*a* can also be calculated using Eq. (7). Due to the steady-flow assumption, flow at 1d 21 (FIG. 2) is the same as at the suction of the upstream stage 12*a*. Knowing the mass flow rates at 1d 21 and SS 11, the mass flow rate at 2s 22 can be calculated from the continuity equation:

$$\dot{m}_{1d}+\dot{m}_{SS}-\dot{m}_{2s}=0 \tag{8}$$

In Eq. (6) the specific enthalpies ($h_{1d}$ and $h_{2s}$) remain as unknowns.

To fix the state at 1d 21, two independent properties are required. The first is pressure, and it is assumed the same as that measured for the sidestream 11. The second property is temperature, calculated using Eq. (4) where s and d respectively denote suction and discharge of the upstream compression stage 12*a*. Compressibility (Z) is a known function of pressure and temperature, so Eq. (4) is a fimction only of $p_s$, $p_d$, $T_s$, $T_d$, and n. The last variable, n, can be determined from manufacturer's data, or from the relationship $$\frac{n-1}{n} = 1 - \frac{\rho}{p}\frac{\partial p}{\partial \rho}\bigg|_T + \frac{k-1}{k\eta_p}\left(\frac{1+\frac{T}{Z}\frac{\partial Z}{\partial T}\Big|_p \eta_p}{1+\frac{T}{Z}\frac{\partial Z}{\partial T}\Big|_p}\right)\frac{\rho}{p}\frac{\partial p}{\partial \rho}\bigg|_T \tag{9}$$

where $\eta_p$=polytropic efficiency=dp/ρdh k=ratio of specific heats=$c_p/c_v$ $c_p$=specific heat at constant pressure=$\partial h/\partial T|_p$ $c_v$=specific heat at constant volume=$\partial u/\partial T|_v$ u=specific internal energy and the quantity held constant, when taking the partial derivatives, is indicated by subscripts after the vertical lines ($|_T$, $|_p$).

Using the measured pressure and estimated temperature at 1d 21 (FIG. 2), enthalpy (h) can be calculated using an equation relating enthalpy, pressure, and temperature (possibly through the density). Such equations are commonly known, and special relationships can be derived for limited regions of operation, if necessary. The enthalpy at 2s 22 can now be calculated from Eq. (6):

$$h_{2s} = \frac{(\dot{m}h)_{1d} + (\dot{m}h)_{SS}}{\dot{m}_{2s}} \tag{10}$$

A rearrangement of the equation relating enthalpy, pressure, and temperature can be used to compute the temperature at 2s 22, assuming the pressure at 2s is the same as that at the sidestream 11; for example, $T_{2s}=f(p_{2s}, h_{2s})$.

The "flow" of importance in turbocompressor antisurge-control is a dimensionless parameter known as reducedflow rate and defined as $$q_s = C\frac{\dot{m}\sqrt{(ZRT)_s}}{l^2 p_s} \tag{11}$$

where $q_s$=reduced flow rate in suction

C=constant l=a characteristic length of the compressor (constant, usually taken as 1.0) and the properties have been selected from those in the suction of the compressor stage.

To calculate a reduced flow rate ($q_s$), mass flow rate ($\dot{m}$) at the flow measurement devices 16, 112 is calculated using Eq. (7); then, $q_s$ is calculated using Eq. (11).

From the above analysis, all quantities appearing on the right-hand side of Eq. (11) are known; thus, $q_s$ can be calculated. The value of $q_s$ along with a value of another independent parameter such as pressure ratio ($R_c=p_d/p_s$) are used to locate the compressor stage's operating point relative to its surge limit. As the compressor stage's operating point nears its surge limit, appropriate control action is taken (i.e., opening a recycle valve) to keep the operating point from crossing the surge limit.

Ideal Gas: Although refrigerants are rarely assumed ideal gases in practice, if the fluid can be considered an ideal gas, some of the above relationships may be significantly simplified because compressibility (Z) is constant at 1.0 for an ideal gas. Eq. (3) then becomes $$p=\rho RT \tag{12}$$

Eq. (4) becomes $$\frac{T_d}{T_s}=\left(\frac{p_d}{p_s}\right)^{\frac{n-1}{n}} \tag{13}$$

Eq. (9) becomes $$\frac{n-1}{n}=\frac{k-1}{k\eta_p} \tag{14}$$

where $k=c_p/c_v$ (the ratio of specific heats). And Eq. (11) becomes $$q_s=C\dot{m}\frac{\sqrt{(RT)_s}}{l^2 p_s} \tag{15}$$

When dealing with ideal gases, another simplification is that specific enthalpy (h) is a function of temperature only, so the specific heat for constant pressure ($c_p$) becomes the ordinary derivative $$\left(c_p=\frac{\partial h}{\partial T}\bigg|\right)_p=\frac{dh}{dT} \tag{16}$$

Accordingly, for an ideal gas $$h=\int c_p dT \tag{17}$$

and sometimes, in limited neighborhoods, $c_p$ can be taken as a constant. This simplifies finding the temperature at 2s 22. Eq. (10) now becomes $$T_{2s}=\frac{(\dot{m}h)_{1d}+(\dot{m}h)_{ss}}{\dot{m}_{2s}c_p} \tag{18}$$

The invention described herein can be executed if the flow rate is not measured at an upstream location, but rather downstream. The mass flow rate at 2s 22 would be taken to be the same as the downstream location, and the mass flow rate at 1d 21 would be calculated using Eq. (8).

Obviously, many modifications and variations of the present invention are possible in light of the above teachings. It is, therefore, to be understood that within the scope of the appended claims, the invention may be practiced otherwise than as specifically described.

I claim:

1. A method for providing antisurge control for a compression system having sidestreams, the compression system comprising a plurality of turbocompressor stages with at least one sidestream bringing flow into a flow passage between two of the compressor stages, and appropriate instrumentation, the method comprising:

(a) using the first law of thermodynamics to estimate a temperature of a flow entering one of the compressor stages; and (b) taking appropriate antisurge control action based upon the temperature of the flow entering the compressor stage.

2. The method of claim 1, wherein the temperature of the flow entering one of the compressor stages is used to determine a location of an operating point of the compressor stage compared to its surge limit.

3. The method of claim 1, wherein the temperature is used to calculate a value for a reduced flow rate (q) entering one of the compressor stages.

4. The method of claim 3, wherein the reduced flow rate (q) is used to determine a location of an operating point of the compressor stage compared to its surge limit.

5. The method of claim 1, wherein the step of using the first law of thermodynamics makes use of a mass flow rate ($\dot{m}$) for a discharge of an upstream compression stage that is calculated using data from instrumentation at a suction of the upstream compression stage.

6. The method of claim 1, wherein the step of using the first law of thermodynamics makes use of a mass flow rate ($\dot{m}$) for a suction of a downstream compression stage that is calculated using data from instrumentation at a discharge of the downstream compression stage.

7. The method of claim 1, wherein a relationship between the pressures and temperatures in suction and in discharge is used in conjunction with the first law of thermodynamics.

8. The method of claim 7, wherein the relationship between the pressures and temperatures in suction and in discharge is a polytropic relationship.

9. The method of claim 8, wherein the ratio of compressibilities ($Z_s/Z_d$) is assumed constant.

10. The method of claim 9, wherein the ratio of compressibilities ($Z_s/Z_d$) is assumed equal to unity.

11. The method of claim 8, wherein a polytropic exponent is calculated using the formula $$\left(\left(\frac{n-1}{n}=1-\frac{\rho}{p}\frac{\partial p}{\partial \rho}\bigg|\right)_T+\frac{k-1}{k\eta_p}\left(\frac{\left(1+\frac{T}{Z}\frac{\partial Z}{\partial T}\bigg|\right)_p\eta_p}{\left(1+\frac{T}{Z}\frac{\partial Z}{\partial T}\bigg|\right)_p}\right)\frac{\rho}{p}\frac{\partial p}{\partial \rho}\bigg|\right)_T.$$

12. The method of claim 8, wherein a polytropic exponent is calculated using the formula $$\frac{n-1}{n}=\frac{k-1}{k\eta_p}.$$

13. The method of claim 11 or claim 12, wherein polytropic efficiency ($\eta_p$) is assumed constant.

14. The method of claim 1, wherein the step of using the first law of thermodynamics utilizes a relationship for specific enthalpy: $h=c_pT$.

15. The method of claim 14, wherein $c_p$ is assumed a function of temperature.

16. The method of claim 14, wherein $c_p$ is assumed a constant.

17. The method of claim 1, wherein the step of using the first law of thermodynamics assumes: adiabatic steady-flow with uniform properties across each inlet and outlet, negligible kinetic- and potential-energy changes, and no work.

18. An apparatus for providing antisurge control for a compression system having sidestreams, the compression system comprising a plurality of turbocompressor stages with at least one sidestream bringing flow into a flow passage between two of the compressor stages, and appropriate instrumentation, the apparatus comprising:

(a) means for using the first law of thermodynamics to estimate a temperature of a flow entering one of the compressor stages; and (b) means for taking appropriate antisurge control action based upon the temperature of the flow entering the compressor stage.

19. The apparatus of claim 18, wherein the temperature of the flow entering one of the compressor stages is used to determine a location of an operating point of the compressor stage compared to its surge limit.

20. The apparatus of claim 18, wherein the temperature is used to calculate a value for a reduced flow rate (q) entering one of the compressor stages.

21. The apparatus of claim 20, wherein the reduced flow rate (q) is used to determine a location of an operating point of the compressor stage compared to its surge limit.

22. The apparatus of claim 18, wherein the step of using the first law of thermodynamics makes use of a mass flow rate ($\dot{m}$) for a discharge of an upstream compression stage that is calculated using data from instrumentation at a suction of the upstream compression stage.

23. The apparatus of claim 18, wherein the step of using the first law of thermodynamics makes use of a mass flow rate ($\dot{m}$) for a suction of a downstream compression stage that is calculated using data from instrumentation at a discharge of the downstream compression stage.

24. The apparatus of claim 18, wherein a relationship between the pressures and temperatures in suction and in discharge is used in conjunction with the first law of thermodynamics.

25. The apparatus of claim 24, wherein the relationship between the pressures and temperatures in suction and in discharge is a polytropic relationship.

26. The apparatus of claim 25, wherein the ratio of compressibilities ($Z_s/Z_d$) is assumed constant.

27. The apparatus of claim 26, wherein the ratio of compressibilities ($Z_s/Z_d$) is assumed equal to unity.

28. The apparatus of claim 25, wherein a polytropic exponent is calculated using the formula $$\left(\left(\frac{n-1}{n} = 1 - \frac{\rho}{p}\frac{\partial p}{\partial \rho}\right)_T + \frac{k-1}{k\eta_p}\left(\frac{\left(1 + \frac{T}{Z}\frac{\partial Z}{\partial T}\right)_p \eta_p}{\left(1 + \frac{T}{Z}\frac{\partial Z}{\partial T}\right)_p}\right)\frac{\rho}{p}\frac{\partial p}{\partial \rho}\right)_T.$$

29. The apparatus of claim 25, wherein a polytropic exponent is calculated using the formula $$\frac{n-1}{n} = \frac{k-1}{k\eta_p}.$$

30. The apparatus of claim 28 or claim 29, wherein polytropic efficiency ($\eta_p$) is assumed constant.

31. The apparatus of claim 18, wherein the step of using the first law of thermodynamics utilizes a relationship for specific enthalpy: $h=c_pT$.

32. The apparatus of claim 31, wherein $c_p$ is assumed a function of temperature.

33. The apparatus of claim 31, wherein $c_p$ is assumed a constant.

34. The apparatus of claim 18, wherein the step of using the first law of thermodynamics assumes: adiabatic steady-flow with uniform properties across each inlet and outlet, negligible kinetic- and potential-energy changes, and no work.

* * * * *